United States Patent [19]

Wille et al.

[11] Patent Number: 4,690,072

[45] Date of Patent: Sep. 1, 1987

[54] RAILWAY CAR BODY STRUCTURAL ARRANGEMENT

[75] Inventors: Herbert S. Wille; Phillip G. Przybylinski, both of Schererville, Ind.; Joe B. Raidt, Lansing, Ill.

[73] Assignee: Pullman Standard Inc., Chicago, Ill.

[21] Appl. No.: 597,125

[22] Filed: Apr. 5, 1984

[51] Int. Cl.[4] ..... B61D 17/00; B61D 7/00; B61D 3/00

[52] U.S. Cl. ..... 105/406.1; 105/199.3; 105/226; 105/416; 105/418

[58] Field of Search ..... 105/414, 226, 228, 238 R, 105/413, 199 CB, 244, 416, 418, 419, 200, 396, 404, 406 R, 199.3, 238.1, 406.1; 296/203, 204, 182, 181, 183

[56] References Cited

U.S. PATENT DOCUMENTS

| | | | |
|---|---|---|---|
| Re. 23,848 | 7/1954 | Gerhardt | 296/183 |
| 658,784 | 10/1900 | King | 105/228 |
| 1,207,176 | 12/1916 | Kadel | 105/406 R |
| 1,279,600 | 9/1918 | Slick | 105/418 |
| 1,475,187 | 11/1923 | Kadel | 105/406 R |
| 2,035,113 | 3/1936 | Blomberg | 105/418 |
| 2,184,337 | 12/1939 | Duryea | 105/226 |
| 2,197,443 | 4/1940 | Wine | 105/419 |
| 2,335,509 | 11/1943 | Hammerstrom | 105/226 |
| 2,473,946 | 6/1949 | Hammerstrom | 105/364 X |
| 3,240,168 | 3/1966 | Charles et al. | 105/418 X |
| 3,719,154 | 3/1974 | Reynolds | 105/226 |
| 3,841,236 | 10/1974 | Hammonds et al. | 105/413 X |
| 4,236,459 | 12/1980 | Teoli | 105/364 X |
| 4,331,083 | 5/1982 | Landregan et al. | 105/418 X |

FOREIGN PATENT DOCUMENTS

| | | | |
|---|---|---|---|
| 0035449 | 2/1980 | European Pat. Off. | 296/182 |
| 1219455 | 1/1971 | United Kingdom | 105/199 CB |

OTHER PUBLICATIONS

*Railway Locomotives & Cars;* Feb. 1958; "Aluminum Center Sills Prove Themselves".

"Gondolas Have Aluminum Bodies"; *Railway Locomotives and Cars;* Apr. 1960; pp. 27–29.

*Primary Examiner*—Robert B. Reeves
*Assistant Examiner*—Scott H. Werny
*Attorney, Agent, or Firm*—Richard J. Myers

[57] ABSTRACT

A railway car body structural arrangement has a bolster fabricated from plates and formed on the upper surface of a bottom closure member of the body of a railway car and rigidly affixed to a bolster post at each side of the car. The lower portions of the bolster posts are affixed to the bolster assembly adjacent to the upper surface of the bottom closure member to enable use of a continuous side sill member on the car. Bearing surfaces which limit the transverse angular movement or roll of the car body with respect to a truck are attached to and project downward from a lower surface of the frame of the truck which is supportingly and pivotally engaged with the center sill substantially directly beneath the bolster.

24 Claims, 6 Drawing Figures

RAILWAY CAR BODY STRUCTURAL ARRANGEMENT

BACKGROUND OF THE INVENTION

1. Field of the Invention

This invention relates to bolsters for railway cars.

2. Description of the Prior Art

Bolsters for railway cars are old and well known. Typically, a bolster is one of two primary load-bearing crossbeams attached to the center sill of a railway car adjacent a point of attachment of the center sill to a truck having one or more wheel and axle assemblies for rollingly supporting the car body and any lading on the car body.

Bolsters are normally formed in two sections. Each section has one end rigidly affixed in a butted relationship to the side of the center sill and the opposite end is extended laterally outwardly from the center sill. The two sections are aligned on each of two sides of the center sill to form a transverse support beam having upper support surfaces at substantially the same height or level as the upper surface of the center sill. A floor structure is normally engaged with those upper surfaces to provide a support platform for cargo to be transported by the railway car.

Typically, a vertically upwardly extending bolster post used to support the side of the car is attached to each of the bolster sections at the laterally outer end of each section. A portion of each bolster post normally extends downward below the floor structure to engage and be affixed to the outer end of the bolster.

SUMMARY OF THE INVENTION

The bolsters of a railway car are positioned above and engage the upper surface of the bolster closure or floor structure of a railway car to form a continuous primary crossbeam which extends over or bridges over the center sill and consequently does not have to be attached to the center sill in a butted relationship. Each of the two ends of the bolster are laterally outwardly spaced from the center sill and a bolster post is attached to each of the two ends at or above the upper surface of the floor structure.

This structure forms a strong, continuous crossbeam which does not need to be affixed in a butted end relationship to two opposite sides of the center sill. This is particularly advantageous when the center sill and the bolster are formed of different metals which cannot be welded to each other effectively, much as steel and aluminum.

Additionally, with this bolster construction, the bolster posts connected to each of the ends of the bolster need not extend below the floor structure. Therefore, continuous side rails may be used which extend the full longitudinal length of the car body.

DETAILED DESCRIPTION OF THE INVENTION

Figure 1:
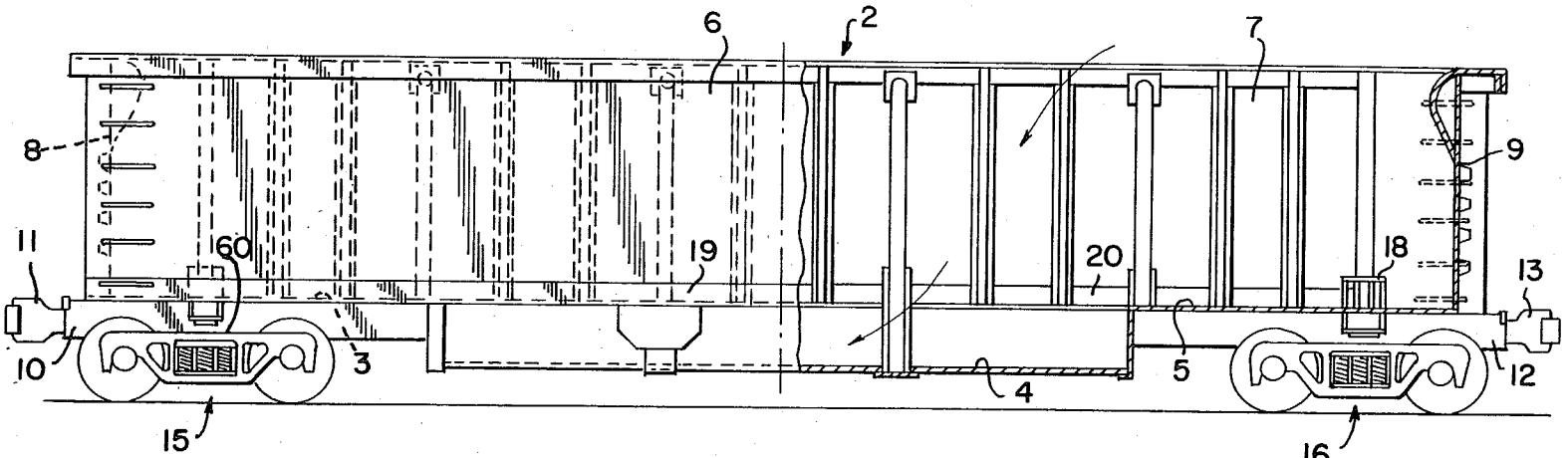
FIG. 1 is a side elevation partially cut away view of a railway car having the bolster construction of this invention.
Figure 2:
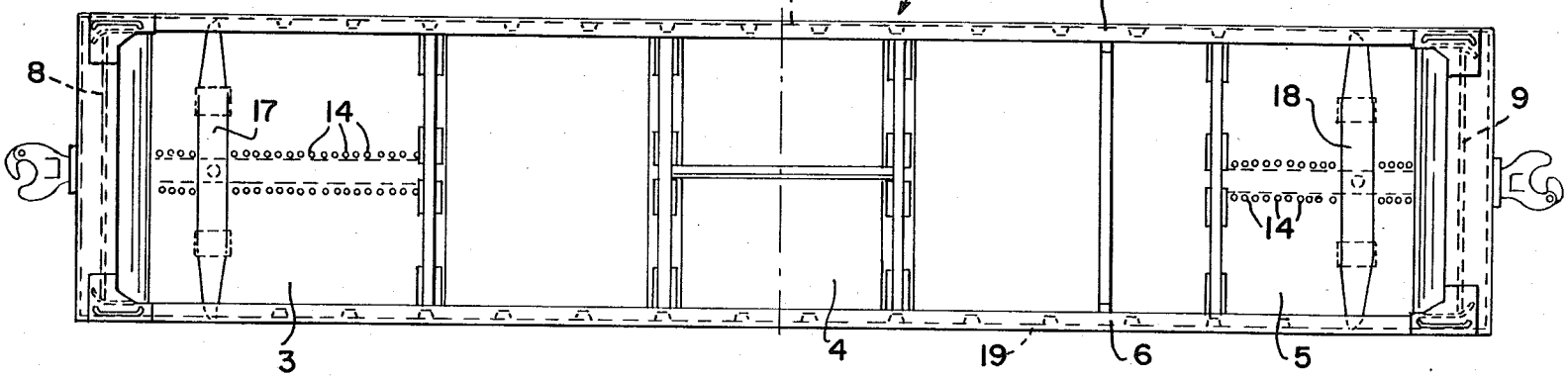
FIG. 2 is a top plan view of the railway car shown in FIG. 1.

FIG. 1 shows a side elevation view of a railway car 2 and FIG. 2 shows a top plan view of the car 2. Car 2 is an open top high side gondola car of the type commonly used to transport bulk cargo such as coal and mining ores. This type of car is shown for the purpose of illustrating the invention, but the invention disclosed in this specification may be applied to a number of different types of railway cars.

Car 2 is comprised of a light-weight cargo carrying structure formed primarily of an aluminum alloy and having bottom closures 3, 4 and 5, a pair of side walls 6 and 7 and a pair of end walls 8 and 9. Bottom closures 3 and 5 are dual-function members or plates which serve as a bottom closure means and also as a force transfer or shear plate means.

Car 2 has a first stub center sill 10 having a coupling means, such as coupler 11, for enabling connection to another car. Similarly, the other end of the car has a stub center sill 12 having a coupling means, such as coupler 13, for connections to another car. Stub center sills 10 and 12 are preferably formed of steel and are engaged with bottom closure and shear plate members 3 and 5, respectively, by a multiplicity of mechanical fasteners as indicated at reference numeral 14.

A pair of truck assemblies 15 and 16 are pivotally and supportingly engaged with the car body to enable the car to rollingly engage a pair of rails.

Car 2 is provided with a front main cross support or bolster assembly 17 positioned above truck assembly 15 and a second main cross support or bolster assembly 18 which is positioned above truck 16. Each bolster assembly 17 and 18 are positioned transverse to the respective center sill 10 or 12 over which it is positioned and extends from side wall 6 to side wall 7 of car 2.

Car 2 has a lowered or depressed floor portion 4 which lowers the center of gravity of the car to increase its stability and to increase the cubic capacity of the cargo structure. Consequently, due to a discontinous center sill, the longitudinal draft and buff loads placed on the car are transferred from one of the stub center sills 10 or 12 to one of the bottom closure and shear plate members 3 or 5.

Members 3 and 5 transfer these force loadings laterally outward to a pair of side sill members 19 and 20 which are rigidly engaged, as by welding, to each of two sides of the members 3 and 5.

Side sill members 19 and 20 are each preferably formed of a continuous aluminum alloy extrusion which extends from one end of the car to the other.

Figure 3:
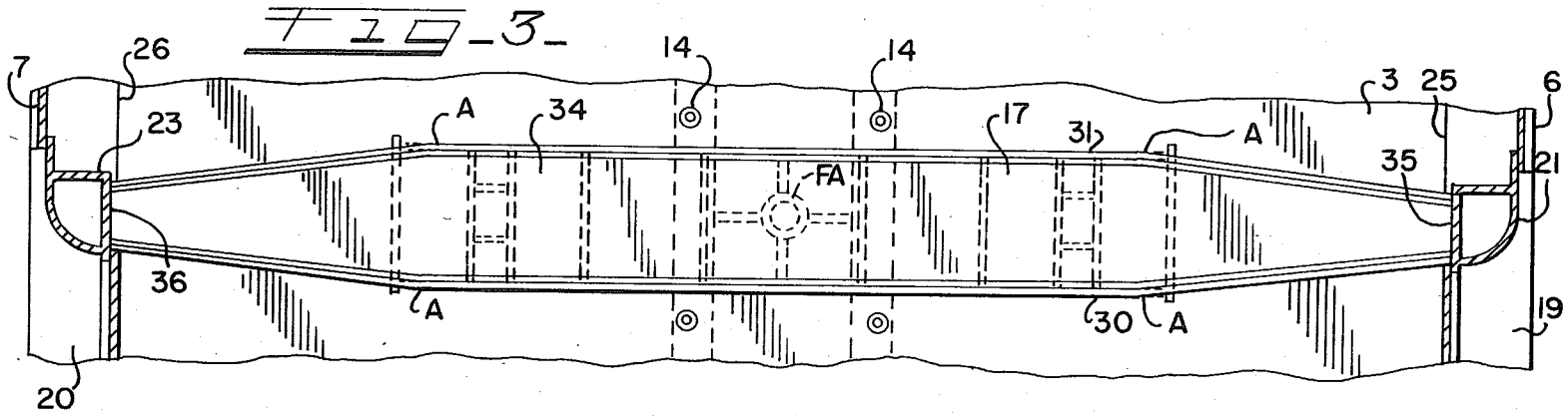
FIG. 3 is an enlarged view of the bolster structure shown in FIG. 2.
Figure 4:
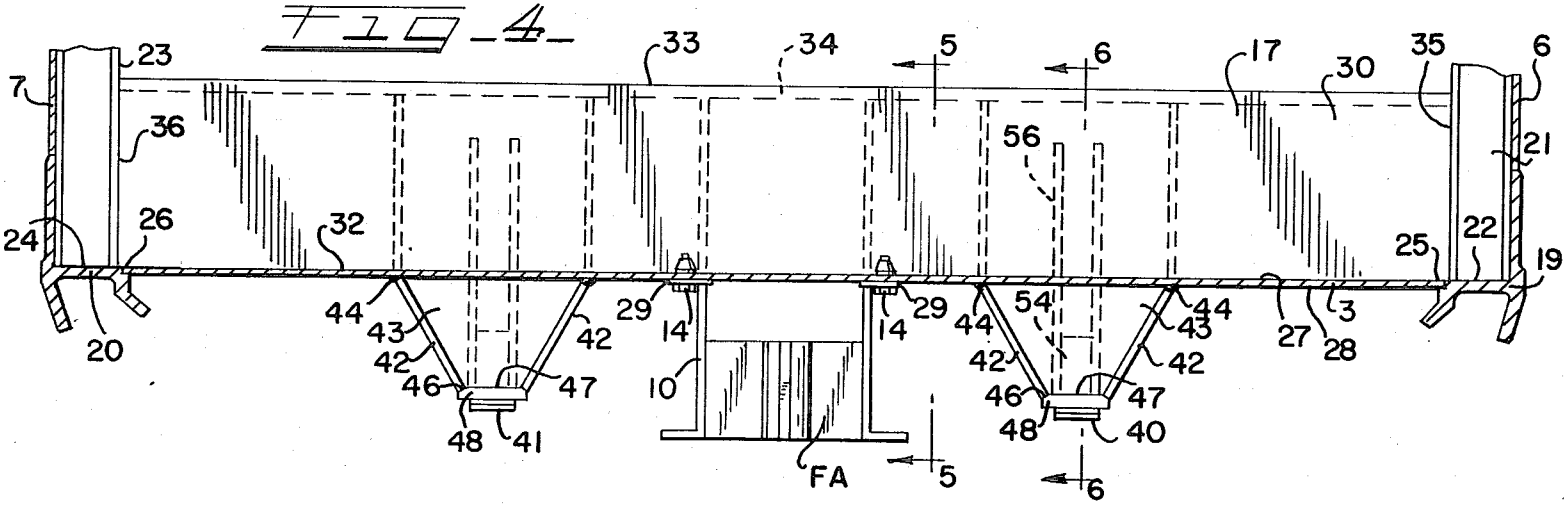
FIG. 4 is an elevation view of the bolster structure shown in FIG. 3.

FIG. 3 is an enlarged view of bolster assembly 17 as shown in FIG. 2. FIG. 4 is a cut away frontal elevation view of car 2 at bolster assembly 17.

An aluminum bolster post 21 has a lower portion 22 which is rigidly affixed, as by welding, to a portion of side sill 19 and extends substantially vertically upwardly to support side wall 6. Similarly, a bolster post 23 has a lower portion 24 rigidly affixed to a longitudinally intermediate portion of side sill 20 and extends upwardly to support side wall 7.

Bottom closure and shear plate member 3 has a first longitudinally extending side portion 25 which is rigidly affixed to side sill 19 and a second longitudinally extending side portion 26 which is rigidly affixed to side sill 20. Bottom closure member 3 has an upper or upward facing surface 27 and a lower or downward facing surface 28. Stub center sill 10 has bearing plate 29 engaged with the lower surface 28 of member 3 and a plurality of mechanical fasteners, such as representative fasteners 14, maintain the plate 3 and center sill rigidly engaged to enable transfer of substantial force loadings between the two members.

Figure 5:
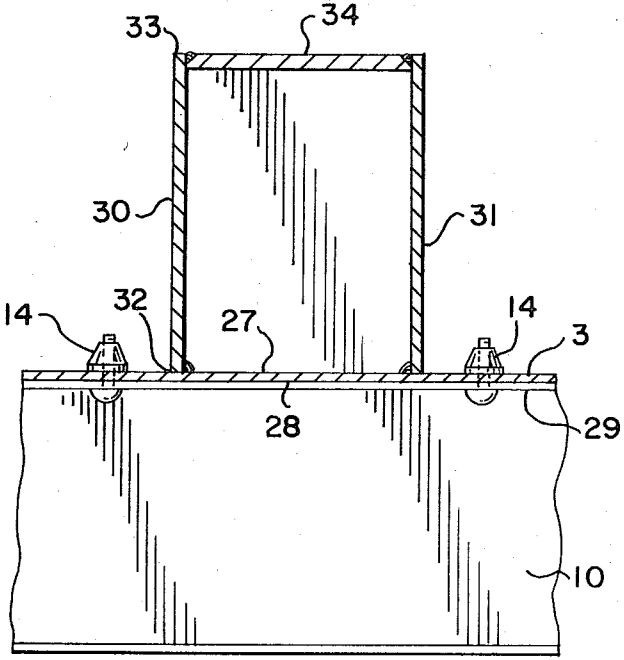
FIG. 5 is a cross-sectioned view of FIG. 4 as indicated by the section line 5—5.

Referring to FIGS. 3, 4 and 5, bolster 17 is comprised of a first bolster side plate member 30 and a second bolster side plate member 31. Each of the side plate members have a lower edge portion, such as lower edge portion 32 of plate 30, which engages and is welded to the upper surface of member 3.

Each of the side plate members 30 and 31 also have an upper edge portion, such as upper edge portion 33 of plate 30. A top plate member 34 is welded to each of the side plates 30 and 31 adjacent to their upper edge portions. All of the welds are substantially continuous to form a strong box-like, fabricated bolster using bottom closure and shear plate member 3 as the lower bolster cover plate.

Bolster assembly 17 has a first end portion 35 which is rigidly affixed at each of the ends of the side plates 30 and 31 and the top plate 34 to a laterally inward portion of bolster post 21. Similarly, bolster assembly 17 has a second end portion 36 which is rigidly affixed to a laterally inward portion of bolster post 23. Ends 35 and 36 are preferably attached to the bolster posts by welding.

Bolster side plates 30 and 31 are each provided, intermediate the portion over the center sill and an end, with an integral angled portion A which forms a laterally outward extending taper to the bolster posts. This configuration enables the complete end of the bolster to be welded to a bolster post and provides sufficient strength at the center of the bolster over the center sill above a conventional filler assembly FA which is rigidly engaged with the center sill to enable pivotal attachment to the conventional kingpin and center plate of a truck in a well known manner. The pivotal attachment allows for pivotal relative movement of the truck and the center sill in a substantially horizontal plane.

Figure 6:
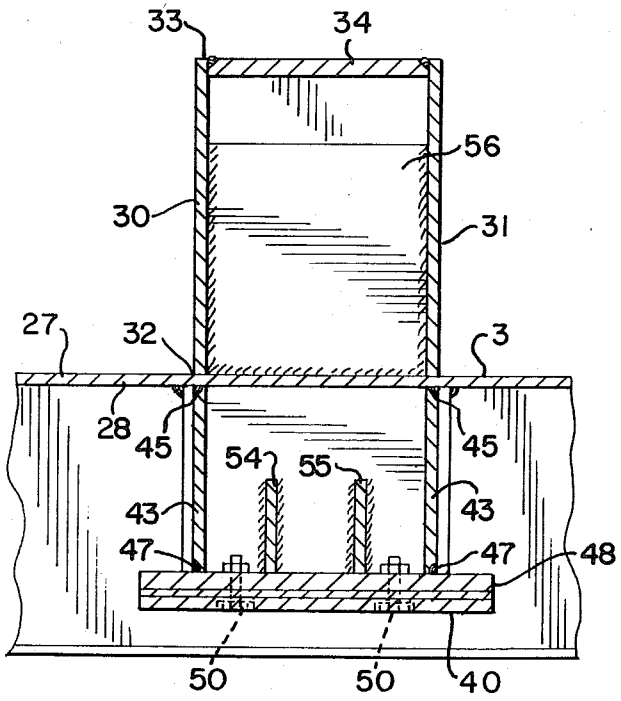
FIG. 6 is a cross-sectioned view of FIG. 4 as indicated by the section line 6—6.

As shown in FIGS. 3, 4 and 6, a car body tilt limiting means, such as bearing pads 40 and 41, are provided beneath the car body. Each of the pads 40 and 41 are suspended from the lower surface 28 of plate 3 and descend downwardly from plate 3. The pads are arranged to contact, upon sufficient tilt of the car body with respect to a portion of the truck mounted to the bolster, a preselected area of the frame 60, as shown for truck 15 in FIG. 1. This contact of the frame by a bearing pad limits the transverse angular movement or roll of the car body with respect to the truck.

Each of the pads is suspended from the plate 3 by a downwardly depending mounting means comprising a pair of side plates 42 and a pair of end plates 43.

An upper end portion 44 and 45, resspectively, of each of members or plates 42 and 43 is welded to surface 28 of plate 3, substantially as shown in FIGS. 4 and 6. A lower end portion 46 and 47 of each of the members 42 and 43, respectively, is preferably welded to a substantially horizontal pad attachment plate 48. Threadedly engaged to each of the plates 48 is a bearing pad 40 and 41 which are preferably formed of steel and replaceably attached to attachment plates 48.

All of the bearing pad stand-off assemblies, except the steel bearing pads 40 and 41, are preferably formed of aluminum.

Appropriate fasteners, such as bolts 50 removably engage a pad 40 or 41 to an attachment plate 48, as best shown in FIG. 6.

A plurality of reinforcement members selectively positioned within the bolster assembly, as indicated by the dotted or bolder lines are provided to further strengthen and rigidify the bolster assembly. Plates such as those indicated by reference numerals 54 and 55 of the bearing pad stand-off assemblies and 56 of the bolster assembly are typical of the aluminum reinforcement members welded to the interior of these assemblies.

As shown in the drawings and described in detail above, the bolster assembly of this invention provides a strong, durable main cross member for a railway car which uses a bottom closure member as the bottom cover to form an integral force bearing structure of the bolster and bridges over the center sill to preclude the need to attach in a butted end relationship, two halves of a bolster to a steel member. Additionally, having the bolster above the surface of the bottom closure enables a strong engagement with a substantial portion of a bolster post while enabling the side sill to be a continuous member not interrupted by one or more cross sectional, strength detractive welds.

The bearing pad assemblies depending from the lower portion of the bottom closure and shear plate are also formed to be substantially integral with the bolster and preclude the need for additional aluminum to steel engagement except for the bearing pad members themselves.

The bolster construction of this invention, as described in detail above, can be used advantageously in many different types and constructions of railway cars.

For example, cars formed substantially all of steel, with either stub center sills or a continuous center sill extending from one end of the car to the other, can be advantageously built utilizing the bolster construction of this invention.

In cars with continuous center sills, the sill is generally the primary draft and buff, or longitudinal tension and compression, force and load bearing member and in these constructions the bottom closure serves primarily as a cargo support.

What is claimed is:

1. A railway car having:

a center sill having an upper surface;

said center sill being a stub center sill;

a bottom closure member having an upper surface and a lower surface;

said upper surface defining a cargo engaging surface;

said bottom closure member having a center portion of said lower surface rigidly engaged with said upper surface of said center sill;

said bottom closure member having two sides laterally outwardly spaced from said center sill;

a pair of side sill members, each engaging and fixedly connected with a respective side of the bottom closure member and having a pair of opposing longitudinal ends;

said bottom closure member serving as a shear plate member for beaming draft and buff force loadings to the two sides of the bottom closure member;

a pair of side wall members each connected with a respective side sill member and extending upwardly therefrom;

the side wall members, the side sill members, and the bottom closure member defining a cargo carrying space therebetween;

a pair of bolster post members each supported adjacent the bottom closure member on a respective side sill member intermediate the longitudinal ends thereof and connected with a respective side wall member for receiving loads therefrom; and a main cross support assembly extending transverse of said center sill and extending between said bolster post members said main cross support assembly being fixedly engaged with said upper surface of said bottom closure member and abutting and being fixedly engaged with said bolster post members providing a structure having additional strength provided by the side sill members extending substantially continuously below the bolster post members;

said main cross support assembly including a pair of longitudinally spaced transversely extending walls, each of said walls having an upper portion and a lower portion, said lower portions being fixedly connected with the upper surface of the bottom closure member;

said main cross support assembly further including a transversely extending top wall being fixedly connected with the upper portions of the transversely extending walls and forming a transversely extending beam with said transversely extending walls and said bottom closure member for transmitting loads laterally inwardly from the bolster post members;

said transversely extending walls and said top wall each having a pair of laterally outward ends;

the bolster post members being located laterally outward of the respective ends of the walls, the ends of the walls engaging and being fixedly connected to respective bolster post member for securely connecting the bolster post members to the main cross support assembly for transferring loads therebetween.

2. The invention as defined in claim 1 in which said stub center sill is formed of steel and said bottom closure and shear plate member is formed of an aluminum alloy and said member is rigidly engaged to said sill by a plurality of mechanical fasteners.

3. The invention as defined in claim 2 in which said main cross support assembly is formed of aluminum and welded to said bottom closure and shear plate member.

4. The invention according to claim 1, and said main cross support assembly having laterally outwardly extending tapered portions connected to the bolster post members.

5. The invention according to claim 1, and said side wall members each being connected to a laterally outward portion of the respective side sill member and connected to a laterally outward portion of the respective bolster post member.

6. The invention according to claim 1, and each of said bolster posts being tubular in cross section.

7. The invention according to claim 1, and each of said bolster posts having a laterally inward generally longitudinally extending wall portion fixedly connected to the transversely extending walls and the top walls.

8. The invention according to claim 7, and each of the wall portions of the bolster posts engaging the walls of the main cross support assembly in a substantially vertical plane.

9. A railway car body having:

a center sill having an upper surface said center sill being a stub center sill;

a bottom closure member having an upper surface and a lower surface, said lower surface of said bottom closure member engaging the upper surface of the center sill;

said upper surface defining a cargo engaging surface;

said bottom closure member having two sides laterally outwardly spaced from said center sill;

a pair of side sill members, each engaging and fixedly connected with a respective side of the bottom closure member and having a pair of opposing longitudinal ends;

said bottom closure member serving as a shear plate member for beaming draft and buff force loadings to the sides of the bottom closure member;

a pair of side wall members each connected with a respective side sill member and extending upwardly therefrom;

the side wall members, the side sill members, and the bottom closure member defining a cargo carrying space therebetween;

a pair of bolster post members each supported adjacent the bottom closure member and fixedly connected with a respective side sill member intermediate the longitudinal ends thereof and connected with a respective side wall member for receiving loads therefrom; and a body bolster extending transversely with respect to said center sill and extending between said bolster post members;

said bolster being fixedly engaged with said upper surface of said bottom closure member and with said bolster post members;

the bolster comprising:

a pair of bolster side plate members continuously extending from one of said sides of said bottom closure member to the other of said sides of said member;

each of said bolster side plate members having a lower edge portion rigidly engaged with said upper surface of said bottom closure member and each of said bolster side plate members having an upper edge portion; and a top plate member being rigidly affixed to said side plate members adjacent said upper edge portion of each of said side plate members and forming a beam with said plate members and said bottom closure member for transmitting loads inwardly from the bolster post members; and each of said side plate members and said top plate member having end portions, said bolster post members being located outwardly of the end portions of the side and top plate members, said end portions abutting and rigidly affixed to the bolster post members to securely connect the bolster post members to the bolster for transferring loads therebetween.

10. The invention as defined in claim 9 in which said bottom closure and shear plate member, said pair of bolster side plate members, said top plate member and said bolster posts are each formed of an aluminum alloy.

11. The invention as defined in claim 10 in which said bolster is a welded assembly.

12. The invention as defined in claim 11 in which said center sill is formed of steel and said lower surface of said bottom closure and shear plate member has a portion rigidly engaged to said center sill by a plurality of mechanical fasteners.

13. The invention as defined in claim 9 and a pair of bearing pads supported on said lower surface of said bottom closure shearplate member, each of said bearing pads being supported on a portion of said lower surface, substantially directly beneath said bolster and laterally outwardly spaced from said center sill for transferring forces through said bearing pads and said bottom closure shear plate member to said bolster.

14. The invention as defined in claim 13 together with a truck pivotally and supportingly engaged with said car body, said truck having a frame and said bearing pads being selectively positioned to contact said frame for limiting roll of said car body with respect to said frame.

15. The invention according to claim 13 and reinforcement means being supported between the bolster side plate members and engaging the upper surface of the bottom closure and shear plate member substantially above said bearing pads for reinforcing said main cross support member and said bottom closure and shear plate member to receive loads from the bearing pads.

16. The invention according to claim 15 and said reinforcement means including a plate member positioned substantially above each bearing pad and fixedly attached to each of said bolster side plates and said upper surface of said bottom closure and shear plate member.

17. A railway car comprising:

a stub center sill;

a bottom closure member having a lower surface portion fixedly engaging the center sill;

a truck pivotally connected with and supporting said center sill;

means for limiting tilt of the railway car being connected with the lower surface portion of the bottom closure member and extending downwardly therefrom to engage the truck as the railway car tilts;

the bottom closure member having an upper surface portion and two opposing lateral side portions;

said upper surface portion defining a cargo engaging surface;

a pair of side sills extending longitudinally with respect to the car, each of said side sills engaging and being connected with a respective lateral side portion of the bottom closure member;

said bottom closure member serving as shear plate member for bearing draft and buff force loadings to two side portions of the bottom closure member;

a pair of side wall members each connected with a respective side sill and extending upwardly therefrom;

the side wall members, the side sills and the bottom closure member defining a cargo carrying space therebetween;

a pair of bolster post members each supported on a respective side sill, the side sill extending substantially continuously below the bolster post member;

a bolster structure extending laterally with respect to the railway car connected to the upper surface of the bottom closure member substantially above the means for limiting tilt;

said bolster structure including a pair of laterally extending longitudinally spaced bolster side walls having a lower end thereof fixedly connected to said bottom closure member, said bolster side walls abutting and being fixedly engaged with the bolster post member;

said bolster structure further including an upper wall being fixedly connected with an upper portion of each of the bolster side walls and forming a beam with said bolster side walls and said bottom closure member for transferring loads laterally inwardly from the bolster post members;

said bolster post members each engaging and being fixedly connected with the bolster side walls and upper wall for securely connecting the bolster post members to the bolster structure for transferring loads therebetween;

reinforcement means supported between said bolster side walls substantially above the means for limiting tilt for reinforcing the bolster structure for receiving loads applied to the means for limiting tilt as the railway car tilts on the truck.

18. The invention according to claim 17 and said means for limiting tilt comprising a pair of bearing pad means each spaced laterally from the stub center sill.

19. The invention according to claim 18 and said reinforcement means including first and second support plate members each fixedly connected to said bolster side walls and said upper portion of said bottom closure member substantially above a respective bearing pad means.

20. A railway car body having:

a stub center sill;

a bottom closure shear plate member having an upper surface portion and a lower surface portion, said lower surface portion being rigidly engaged with said center sill, said upper surface portion defining a cargo engaging surface;

said bottom closure shear plate member having first and second sides laterally outwardly spaced from said center sill and beaming draft and buff force loadings to said sides;

first and second side sill members rigidly engaged with said first and second sides respectively, and a pair of sidewall members each connected with a respective side sill member and extending upwardly therefrom the side wall members, the side sill members, and the bottom closure shear plate member defining a cargo carrying space therebetween;

first and second bolster posts each being supported substantially above a longitudinally intermediate portion of a respective side sill member and rigidly engaged therewith, said side sill members extending substantially continuously beside the bottom closure shear plate member and extending substantially continuously below said bolster posts whereby the resulting structure has additional strength provided by the substantially continuous side sill members not interrupted by cross sectional strength detractive welds; and a body bolster comprising:

first and second bolster side plate members, each of said side plate members having a first end abutting and rigidly engaged with said first bolster post and a second end abutting and rigidly engaged with said second bolster post, said first and second bolster posts each being positioned laterally outward of the respective end of the bolster side plate member engaged therewith; and said bolster side plate members having a lower edge portion rigidly engaged with said upper surface portion of said bottom closure shear plate member whereby said bottom closure shear plate member serves as a bottom structural closure plate for said bolster and a top plate member fixedly connected to upper portions of the bolster side plate members and extending therebetween, said top plate member being fixedly connected with the bolster posts for receiving loads therefrom;

said top plate member and side plate members forming a box-like beam for transferring loads laterally inwardly from the bolster posts.

21. The invention as defined in claim 20 in which said center sill is formed of steel and said car bottom closure shear plate member is rigidly affixed to said center sill by mechanical fasteners.

22. The invention according to claim 20, and each of the bolster side plate members having first and second angled portions forming first and second laterally outwardly extending tapers in said bolster connected to respective bolster posts.

23. The invention as defined in claim 20 and said bottom closure shear plate member, said side sill members, said bolster posts, and said bolster side plate members each comprising an aluminum member.

24. The invention as defined in claim 23 in which said aluminum members are rigidly engaged by welding.

* * * * *